United States Patent [19]

Constant

[11] 3,965,472

[45] June 22, 1976

[54] OFF-RESONANT CHAFF SYSTEM FOR A LARGE TARGET VIEWED BY LOW FREQUENCY RADAR

[76] Inventor: James Nickolas Constant, 1603 Danbury Drive, Claremont, Calif. 91711

[22] Filed: Apr. 10, 1974

[21] Appl. No.: 459,542

Related U.S. Application Data

[63] Continuation of Ser. No. 304,546, Nov. 7, 1972, abandoned, which is a continuation of Ser. No. 69,185, Sept. 2, 1970, abandoned.

[52] U.S. Cl. ..... 343/18 E; 343/18 B

[51] Int. Cl.[2] ..... H04K 3/00

[58] Field of Search ..... 343/18 E, 18 R, 18 B

[56] References Cited

UNITED STATES PATENTS 3,221,875 12/1965 Paquette ..... 343/18 E 3,500,409 3/1970 Cash ..... 343/18 E

OTHER PUBLICATIONS

Schivley, G. W. "History of Chaff Development" Wright Air Development Center Technical Note 59–6, Jan., 1959.

*Primary Examiner*—Maynard R. Wilbur
*Assistant Examiner*—G.E. Montone
*Attorney, Agent, or Firm*—Harris, Kern, Wallen & Tinsley

[57] ABSTRACT

A system for concealing radar targets. A chaff system with low deadweight ratio, low chaff birdnesting, lossless wire performance, low vulnerability and high dispensing reliability. A chaff system for masking large size targets viewed at low radar frequencies.

4 Claims, 6 Drawing Figures

OFF-RESONANT CHAFF SYSTEM FOR A LARGE TARGET VIEWED BY LOW FREQUENCY RADAR

This is a continuation of application Ser. No. 304,546, filed Nov. 7, 1972, which was a continuation of application Ser. No. 69,185, filed Sept. 2, 1970, both abandoned.

This invention relates to the masking of radar targets and more particularly to the concealment of targets, being examined by radars, by chaff.

In many instances it is desirable to conceal the position or identification of a particular target. A typical example is in the field of penetration aids. In his field vehicles, boosters, satellites, etc., can be readily located and identified using radars. therefore, a suitable device, such as the off-resonant chaff system, permits the target being examined by the radar to be completely concealed and its position and identification to remain unknown to the radar. The term chaff is used to indicate the presence f wires in the spatial vicinity of the target. The wires are resonant at the radar frequency by having lengths which approximately equal the radar half-wavelength. In many modern applications, the radar frequency is substantially at or near the target's natural frequency of oscillation. Many different lengths of wires are employed to cover a wide range of possible radar frequencies. The term masking is used to indicate the degree of concealment of a radar target by chaff.

Conventional chaff systems presently in use are based on electromagnetic principles of the random scattering of radar emissions by wires for their operation. Typically, a spectrum of wire lengths is employed to cover the expected band of radar frequencies with many wires generally available at each length. In such systems the main criteria which determine their effectiveness (masking performance, cost, reliability, vulnerability, an penetrability) are the deadweight ratio, chaff birdnesting, dispenser complexity, and the finite conductivity of wires. The deadweight ratio of a chaff system determines the ratio of gross hardware which is needed to deploy the chaff to the net usable chaff payload. Thus, the deadweight ratio determines the chaff system physical weight and size. Chaff birdnesting is a term which denotes the percentage of wire chaff which can be deployed by a chaff system as individual reflectors with physical separation between wires of at least half-wavelength. The presence of bird-nesting indicates that a percentage of the net chaff payload deploys irregularly with wires intermeshed physically and electrically and results in a loss of otherwise usable reflectors and system masking performance. Dispenser complexity defines the degree of sophistication at which the usable chaff must be packaged and maintained for subsequent deployment and dispensing and seriously degrades the chaff system reliability of operation. Finally, the finite conductivity of wire chaff results in ohmic losses which degrade the chaff system masking performance.

In conventional chaff systems utilizing a spectrum of wire lengths, the chaff system effectiveness is critically limited by the system deadweight ratio, chaff birdnesting, dispenser complexity, and the finite conductivity of wire chaff. In such systems, the attainment of a satisfactory physical size and weight of the chaff system is accomplished at extremely high deadweight ratios, high percentage of chaff birdnesting, extremely sophisticated complexity of chaff dispensers, and high ohmmic losses for wires employed. Combined, these criteria result in the significant degradation of the chaff system effectiveness.

Radar chaff presently known to applicant consists of electric conductors cut into dipoles having small diameters and having a length which determines the particular frequency at which they will resonate. The general relationship between the length of an object and its natural wavelength of oscillation is $l=\lambda/2$ (length equals wavelength/2) so that knowing the wavelength of a radar determines the length of a dipole while knowing the size of a target determines its natural wavelength. Thus the magnitude of the dipole echo when resonating at high frequency is much greater than that given by a large target whose natural oscillation occurs at a much lower frequency. Therefore, in order to simulate the radar return of a large target, such as an aircraft of reentry vehicle or missile warhead, at radar frequencies far above the target resonant frequency, a relatively small volume of chaff dipoles are needed having their lengths cut short corresponding to high frequencies. All that is required is to have enough tuned dipoles so as to give a radar response larger than the target echo at high frequency. For example, viewing an aircraft target which resonates at 100 mHz using UHF, L, S, C, X band portions of the radar spectrum is the typical application encountered for conventional chaff. In the prior art, the dipole length is dimensioned to resonate at the radar frequency.

The weight, volume, and size of dipoles have been the main concerns of radar chaff design and successive chaff designs in the prior art have produced smaller diameter dipoles, smaller weights, and smaller volumes and have introduced the problems of birdnesting and ohmic losses about which more will be said later. As the length-to-diameter of a dipole is increased, by reducing its diameter or increasing its length or both, the dipole fails to maintain its rigidity and tangles or birdnests with other like dipoles with effect the loss of performance. As example, if 1,000 dipoles are needed to give a radar response which just equals the target echo and if 90 percent of the dipoles birdnest and are lost as effective independent resonators, only 100 dipoles remain and the target echo cannot be masked. The esign predicament is obvious; while smaller diameters of dipoles are needed to conserve upon the weight, volume, and size of dipoles and their associated canisters and while longer lengths of dipoles are needed to resonate at low radar frequencies, these requirements aggravate birdnesting and degrade the chaff performance. The problem is additionally compounded by increasing ohmic losses as smaller diameter dipoles are utilized.

The radar response of a dipole is given in the article by Van Vleck et al "Theory of Radar Reflection from Wires or Thin Metallic Strips" appearing in the March 1947 issue of Journal of Applied Physics, in the report by Tai "Radar Response From Thin Wires" Stanford REsearch Institute Technical Report No. 18, Mar. 1951, in the reports by Gamara "On Scattering from Thin Wires" and "A Note on the Scattering from Very Thin Wires of Some Length" Lockheed Missiles & Space Company Technical Reports B-07-65-10 Rev A ASTIA AD No 477803 November 1965 and B-15-66-1 March, 1966, in the report by Sevick "Experimental and Theoretical Results on the Backscatter Cross Sections of Coupled Antennas" Cruft Laboratory, Harvard University, Technical Report No 150,1952, and in the Article by Crispin and Maffett "Radar Cross Section Estimation for Simple Shapes" appearing in the August 1965 Proceedings IEEE.

The radar response of a large target is given in the article by Crispin and Maffett "Radar Cross Section for Complex Shapes" appearing in the August 1965 Proceedings IEEE.

The prior art of radar chaff is given in the report by Schivley "History of Chaff Development" Wright Air Development Center Technical Note 59-6 ASTIA Doc No. 208853 January, 1959. Prior art radar chaff is shown in U.S. Pat. to Paquette No. 3,221,875; Sorenson U.S. Pat. No. 3,308,759, Johnson U.S. Pat. No. 3,137,231, and Turner et al. U.S. Pat. No. 3,544,997.

The prior art relies on radar chaff resonating at the radar frequency (Shivley page 2, lines 8–12 and page 6, lines 8–9, Paquette col. 1, lines 27–29) and thus has failed to meet the modern requirement for radar chaff for large targets being viewed by low frequency radar, i.e., when the radar frequency approaches the target's natural frequency of oscillation. Obviously, in order to simulate the radar return for this case using the prior art, requires cutting the dipoles at lengths for resonating at the low radar frequency and this leads to very long dipoles and birdnesting. Since enough tuned dipoles must be provided so as to give a radar response larger than the target echo at the lower radar frequency, the demand for extremely small diameter dipoles at such long lengths becomes great, with a result of significant loss of performance by the chaff because of the excessive birdnesting and ohmic losses. As example, again viewing the aircraft target which resonates at 100 mHz using the VHF portion of the radar spectrum, say the radar operating at 135 mHz ($\lambda$=2.22 meters) will require a dipole length of 1.11 meters which is an ineffective length for conventional chaff. It appears therefore that while radar chaff in the prior art has the potential, its apparatus and method fail when simulating a large target at or near the target's natural frequency of oscillation, i.e., at low radar frequencies, for example below VHF. Conventional dipole chaff does not work well below 600 mHz (Schivley page 6 particularly lines 26–28 and page 7 particularly lines 31, 32). As a consequence, non-chaff means such as rope chaff, quasi-chaff means as long lengths of folded or coiled chaff, and environmentally induced noise generators have been employed in lieu of rigid dipole chaff at low radar frequencies below 600 mHz. Thus, the prior art relies on rope, i.e., non-chaff means, at frequencies below 600 mHz (Shivley page 6, lines 25–42). The Paquette reference (col. 1, lines 34–37), in fact, suggests the use of rope below 4000 mHz (1.5 inches). It will be appreciated by those skilled in the art that the distinction between dipole chaff and rope in the prior art is usually based on the frequencies which can be masked by each. Thus, the prior art (Shivley page 6, lines 3–5) defines the use of dipole chaff above 600 mHz (10 inches) and in some cases (Paquette col. 1, lines 32–34) above 4000 mHz (1.5 inches). On the other hand, the prior art (Shivley page 6, lines 25–42) defines the use of rope below 600 mHz (10 inches) and in some cases (Paquette col. 1, lines 34–37) below 4000 mHz (1.5 inches).

There is no radar chaff known by applicant for large targets such as aircraft and reentry vehicles being viewed by low frequency, say VHF band, radar. Conventional chaff is limited to its use for large targets being viewed by high frequency (UHF, L, S, C, X band) radar. The prior art practice dimensions or cuts its dipoles to resonate at the radar frequency (Schivley page 6 lines 3, 4, 5, and page 7 lines 23 and 24). By way of contrast, the system of the present invention requires that its dipoles be cut to resonate at a frequency above the radar frequency. For example, a large target viewed by VHF radar requires dipoles tuned at UHF band in accordance with the system of the present invention. This contrasts with the prior art which requires its dipoles to be tuned at the radar frequency at VHF.

The present invention overcomes the serious limitations of the prior art and is directed to the design of radar chaff for simulating the return of large targets at or near their resonant frequency without loss of performance due to birdnesting and ohmic losses. In accordance with the present invention (1) the dipole length stays above the radar frequency at a safe distance with numerous dipoles providing off-resonant low frequency masking of the target, (2) the dipole length-to-diameter ratio remains below a certain limit for minimizing birdnesting i.e., dipoles stay rigid, and (3) the dipole diameter remains above a certain limit for minimizing the ohmic loss. In summary, the present invention teaches the apparatus and method of radar chaff for large targets viewed by low frequency radar — a task accomplished at present using nonchaff means.

The present invention is directed to a chaff system which is highly efficient and which overcomes many of the problems and limitations present in conventional chaff systems. In accordance with the present invention a single wire length may be employed to cover the expected band of radar frequencies with many wires available at the given length. The chaff system in accordance with the present invention has a low deadweight ratio, low birdnesting of chaff wires, simple chaff dispenser, and negligible ohmic losses for wires employed thereby providing a highly effective system. The term effective is used to denote the chaff system performance in the areas of masking targets, system costs, reliability, vulnerability, and penetrability.

Utilizing the system of the present invention the effective concealment of radar targets can be obtained with small size and weight deployment and dispensing hardware.

It is therefore an objective of this invention to provide an effective low cost chaff system which can be utilized in the concealment of radar targets.

Another objective of this invention is to provide a chaff system with low deadweight ratio, low chaff birdnesting, high reliability, and lossless wire performance.

A further objective of this invention is to provide a chaff system with high masking concealment performance, low cost, high reliability, low vulnerability, and high penetrability which is capable of operating over wide radar frequency bands and capable of masking the largest size targets.

Other objectives of the present invention will become more apparent upon consideration of the following specifications and annexed drawing, in which.

The system of the present invention consists of a deployment system which inclues a chaff dispenser with chaff wires. The deployment system may be any one of any number of types subject only to the constraints imposed in its use as an off-resonant chaff system in accordance with the techniques of the present invention. Any of the well known types of chaff deployment systems having chaff canisters, dispensers, ejection tubes, deployment modules, chaff containers, and the like for dispensing of chaff to the spatial vicinity of targets may be utilized, the exact choice depending upon the particular application at hand. The chaff dispenser portion of the deployment system may be any one of any number of types subject only to the constraints imposed in its use by techniques of the present invention. Any of the well known types of chaff dispensers may be utilized. Any of the well known types of chaff wire may be utilized subject only to the constraints imposed by the teachings of the present invention.

Figure 1:
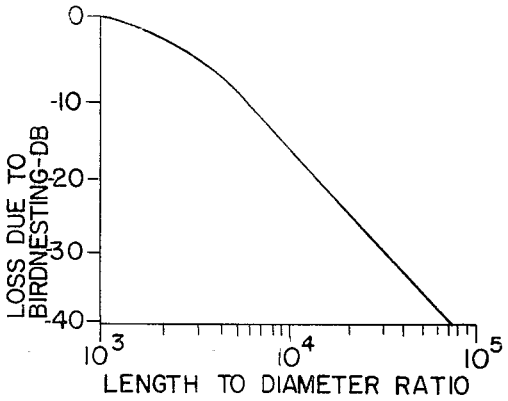
FIG. 1 is a plot which illustrates the degradation in a chaff system as a function of the length-to-diameter ratio of chaff wires employed.

In order to describe the effects of high deadweight ratios and birdnesting of chaff reference is made to FIG. 1. Conventional chaff system designs consist of providing a spectrum of wire lengths to cover the expected band of radar frequencies with many wires generally available at each length. To meet a possible low frequency requirement (VHF) long dipole lengths are employed which impose severe problems in the design of the deployment and dispensing components of the chaff system. Should the dipoles be packaged at their full length, long chaff canisters results with the attendant escalation of system deadweight hardware weights involving canisters, dispensers, ejection tubes, deployment modules, and containers. As a consequence, the chaff system size and weight tends to increase at the expense of the wire diameter employed. The reduction of wire diameters is a consequence of the desire to accomodate the increased overall system weight. On the other hand, should the wires be folded or wound to conserve system size and weight the sophistication of the internal dispenser construction increases to permit the proper unfolding and erection of individual wires with consequences the decrease in system reliability of operation and the additional compounding of the birdnesting problem which already exists when dispensing straight unfolded wires. FIG. 1 illustrates the degradation in decibels (db) as a function of the wire length-to-diameter ratio of straight unfolded wires. it can be seen in this figure that wire length-to-diameter ratios above about 2500 to 3000 result in appreciable degradations with the subsequent loss of making performance. Additional losses can be expected when the wires are folded or coiled to conserve the system size and weight.

Figure 2:
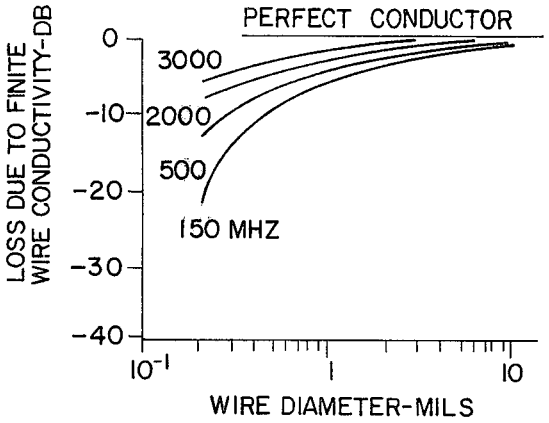
FIG. 2 is a plot which illustrates the degradation in a chaff system as a function of the wire diameter and radar frequency employed.

Referring to FIG. 2, the degradation which results in the radar cross section of thin wires due to their finite conductivity is given as a function of the wire diameter and the radar frequency employed. It can be seen that sizable losses can occur when using very small diameter sizes at very low radar frequencies. Thus, at 150 MHz the broadside radar cross section ($\sigma$) of a 1 mil (1/1000 th inch) wire degrades from about 0.85 $\lambda^2$ to 0.3 $\lambda^2$, where $\lambda$ is the radar operating wavelength, or by a factor of about −4 db.

For a 20 inch length of wire, FIG. 1 indicates that in order to keep the birdnesting loss within − 3 db, the wire length-to-diameter ratio should be no greater than about 2500 to 3000 and the wire diameter should therefore be no less than about 6 – 8 mils. FIG. 2 indicates that this particular selection for the minimum wire diameter results in a neglibible loss due to the finite conductivity of wires.

In summary, the dominant problems encountered in the design of conventional chaff systems are:

1. High deadweight ratios, defined as the ratio of non-usable hardware to usable chaff in a chaff system. This has forced the designer to fold and coil wires and to use very small wire diameters with the consequent increase in birdnesting and ohmic losses due to finite wire conductivity and therefore the degraded effectiveness of chaff systems.

2. Chaff birdnesting. The use of small wire diameters has resulted in the significant loss of chaff system masking performance.

3. Internal dispenser complexity has resulted in a significant drop in the reliability of such systems and has additionally compounded the birdnesting problem especially where large length-to-diameter ratios have been employed in the design.

4. Finite conductivity of wires results in the significant loss of masking performance, especially where very small with diameters have been used at very low radar frequencies.

The predicament therefore in the design of conventional chaff systems in many applications has been the use of high length-to-diameter ratios and small diameters of wires employed, and the use of folded or coiled wires to conserve length and system size and weight. The result has been the significant degradation of the chaff system effectiveness. To keep the deadweight ratio low the long wires must be folded or coiled. Each of these options becomes unattractive beyond certain frequency limits. Folded and coiled wires have the tendency to birdnest especially at the long to offset this effect through the use of more wires results in using smaller wire diamters in a given application thus increasing the length-to-diameter ratio and further increasing the birdnesting, internal dispenser complexity, wire losses due to the finite conductivity, and chaff system effectiveness. Thus, operation of such systems at very low frequencies is limited in many applications. The conventional chaff system therefore has the potential to achieve the masking of radar targets but appears to be constrained to relatively poor performance especially at low radar operating frequencies. The conventional chaff system is not a preferable configuration in this invention. The off-resonant chaff system of the present invention can, however, effectively mask radar targets at low radar frequencies and, therefore, is a preferable configuration for this invention. In this technique, a single wire length is employed to cover the expected band of radar frequencies with many wires available at the given length. The length of wire is chosen to be fully compatible with existing dimensional, size, and weight constraints in the deployment system leaving the choice of the wire diameter which fully meets the constraints imposed by chaff birdnesting and the finite conductivity of wires, as discussed previously. For example, if in a given application the chaff deployment system is constrained to a length of 20 inches then this becomes the length of wire employed. For this case the minimum wire diameter would be about 6 mils. No other wire lengths are need since off-resonant chaff response is provided by including many dipoles at this same length. The hardware for the chaff system of the present invention therefore meets dimensional constraints for the particular application as well as constraints imposed by chaff birdnesting and finite conductivity of wires.

Figure 3:
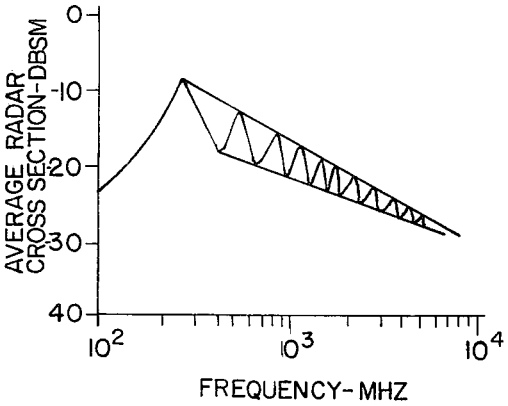
FIG. 3 is a plot which illustrates the average radar cross section of a single 20 inch wire as a function of the radar frequency employed.

FIG. 3 illustrates the average radar cross section of a 20 inch length wire, averaged over all aspect angles, as a function of frequency. The response is characterized by a Rayleigh region dropoff to the left of the resonant peak which occurs at a frequency of about 270 MHz ($\lambda$=1.11 meters) and an optical region dropoff to the right of the resonant peak, this dropoff being accompanied by local resonances which are confined to a maximum-minimum envelope, as shown in the figure. The envelop of maxima assumes a value of about 0.15 $\lambda^2$ at resonance and falls off approximately as $\lambda^{-4}$ in the Rayleigh region and approximately as $\lambda^{1.25}$ in the Optics region (where $\lambda$ is the radar operating wavelength). Thus, the maximum average radar cross section of a single dipole can be approximated as:

| | | |
|---|---|---|
| $0.15\lambda_R^2$ | At Resonance | |
| $0.15(f/f_R)^4\lambda_R^2$ | Raleigh Region | (1) |
| $0.15(f_R/f)^2\lambda_R^2$ | Optics Region | |

where $f$ is the actual radar frequency, $f_R$ and $\lambda_R$ are the frequency and wavelength at resonance. This description of the average response of a dipole is qualitative in nature and is given only to illustrate the performance of a single wire. It can be seen that the response of a single wire covers a band of radar frequencies.

Figure 4:
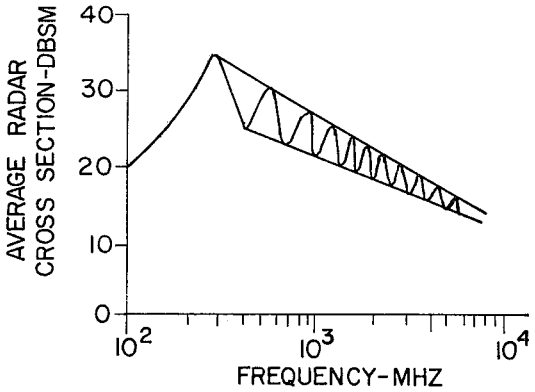
FIG. 4 is a plot which illustrates the average radar cross section of 20,000 20 inch wires separated by at least half-wavelength as a function of the radar frequency employed.

Referring to FIG. 4, the response of 20,000 wires has been obtained by adding the response of a single wire 20,000 times. This procedure assumes the wires to be spaced by at least half wavelength separations and no ohmic losses, precisely the case for the chaff system of the present invention. In an actual aggregate of wires in space or chaff cloud, the wires are randomly oriented at any given instant so that statistical fluctuations will actually occur about the average response given in the figure. This phenomenon is quite helpful in concealing targets and will be discussed later.

If the individual wires are spatially distributed in a chaff cloud whose volume is V and if the radar spatial resolution volume is $V_R$, then the response given by FIG. 4 must be reduced accordingly by the factor $V_R/V$, in db. Typically, in ballistic radar applications, the ratio $V_R/V$ varies with the proximity of the chaff cloud to the viewing radar. At long ranges, the chaff cloud is usually contained within the radar beam in one or a few radar resolution cells. As the cloud approaches the radar and re-entry, at short radar range, many radar cells are contained in the chaff cloud. This is by virtue of the fact that the chaff cloud grows in time while the radar cell decreases as the chaff cloud approaches the radar. Values as low as −30 to −40 db may be encountered for the ratio $V_R/V$ during late re-entry.

Figure 5:
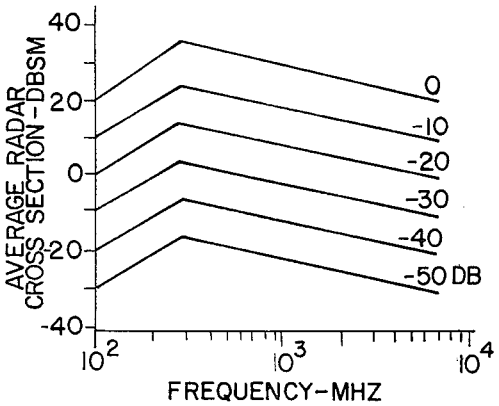
FIG. 5 is a plot which illustrates the masking performance of the chaff system of FIG. 4 as a function of the radar frequency employed and the spatial resolution of the radar.

FIG. 5 gives the response of 20,000 20 inch wires both as a function of the radar frequency employed and the spatial resolving power of the radar. This figure clearly indicates the masking level and masking bandwidth variation for this particular example. The term masking level denotes the amplitude of the chaff system response whereas the term masking bandwidth denotes the band of radar frequencies covered by the response. It can be seen that both the masking level and masking bandwidth decrease as the radar resolution cell decreases. FIG. 5 also illustrates that for a given radar resolution cell size, the masking level and masking bandwidth are inversely related to the chaff cloud volume size.

Figure 6:
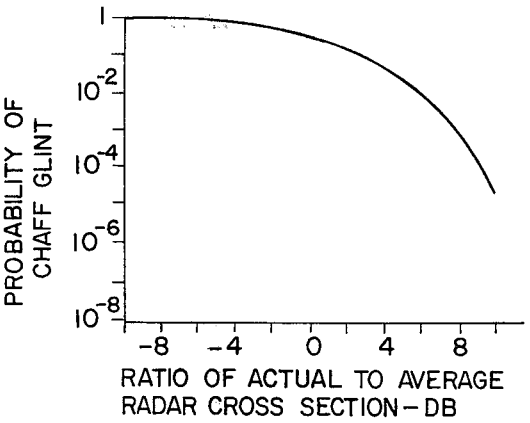
FIG. 6 is a plot which illustrates the probability distribution of seeing chaff at levels other than the average radar cross section of any aggregate of chaff wires.

Referring to FIG. 6, the probability of seeing an occasional chaff glint above the average value of the chaff radar cross section, employed in the construction of FIGS. 4 and 5, is a well establised phenomenon and is given in this figure which shows the chaff distribution function. Thus, the probability of seeing a chaff level or glint 10 db above the average radar cross section level of chaff is about 5in 100,000. If the chaff cloud contains 1,000 radar resolution cells then the probability of seeing a chaff glint at any instant in the chaff cloud is 5 percent. Prolonged observation of the chaff cloud will certainly increase the probability of seeing occasional chaff clints. This occasional glint from the chaff may be helpful since it may be confused by the radar with the occasional glint from a target.

The masking power of the system of the present invention will be briefly compared to that for a conventional chaff system. It will be noted that all targets with characteristic dimensions less than about 20 inches will be readily masked by the off-resonant chaff system which employs 20,000 20 inch wires, each wire with a 6 mil diameter. This is by virtue of the fact that the response of such objects never exceeds the level or bandwidth of the off-resonant chaff system of this example. Masking of such targets occurs at all radar frequencies provided that the radar resolving power ($V_R/V$ ratio) never becomes less than about 1/20,000 or −43 db. This condition for the radar resolving power implies the resolution by the radar of individual wires in the chaff cloud, an extremely unlikely situation. More importantly, however, targets with characteristic dimensions which are greater than 20 inches will have responses which resonate at frequencies below 270 MHz and at levels about the average level of 0.15 $\lambda^2$ so that the larger targets will have responses that resonate at lower frequencies and at higher levels. It becomes increasingly more difficult to conceal large size targets therefore if the chaff deployment system is constrained to a 20 inch length, especially if the radar has high resolving powers. If the target has the characteristic dimension of 40 inches its responses will resonate at 135 MHz at the level 0.15 $\lambda^2$ which is clearly within the masking power (masking level and masking bandwidth) of the off-resonant chaff system of the present invention. For the same deployment constraint of 20 inches, deadweight ratio, and usable chaff payload, a conventional chaff system could implement 10,000 wires at 40 inch length and 6 mil diameter but would require the folding of wires to meet the 20 inch dimensional constraint. For this case, the chaff system response would resonate at 135 MHz at a level 6 db above the level of the off-resonant chaff system since resonance levels between the two systems vary as the square of their resonant frequencies but would be degraded by a factor of − 3 db since but half of the wires are now available, by about −7 db since the wire length to diameter ratio has increased by a factor of 2 from 3300 to 6600, and by perhaps − 10 db since the wires have been folded; or perhaps for a total of −14 db which is a significant drop in the otherwise theoretically attainable masking performance of the conventional chaff system. Furthermore, if the conventional chaff system designer attempts to overcome the inherent degradation in masking performance by including more wires but with smaller wire diameters, the expected gain in the conventional chaff system response is dramatically reversed by further losses incurred by the birdnesting of wires and the appearance of severe ohmic losses at the now smaller wire diameters employed in the conventional chaff system. If the conventional chaff system designer chooses to provide more chaff wire in a larger deployment and dispensing system he then forces the increase in the chaff system deadweight ratio, since increasing the usable chaff payload requires a correspondingly much greater increase in the chaff system gross weight. This simple comparison of the two systems — the off-resonant chaff system of the present invention and the conventional chaff system — is sufficient to indicate the increase, often dramatic in many applications, which can be expected by using the system of the present invention to conceal large size targets at low radar frequencies.

The inbuilt complexity which is associated with conventional folded or coiled internal chaff dispensing architectures is intended to reduce the troublesome effects of chaff birdnesting through means of unfolding, uncoiling and erecting individual chaff wires to their useful straight configuration. From a reliability standpoint however, the reverse is true since the probability of failure of a wire to properly unfold is a direct function of the internal complexity which is used to deploy and dispense the chaff. Unless the individual chaff wires can be deployed and dispensed so that they can erect to their straight configuration and maintain at least one-half wavelength physical separations between wires, the entire theory of predicting the scattering of electromagnetic energy from a chaff cloud is preempted and no correlation can be obtained between the theoretical potential of the conventional chaff system and its actual performance. The fact is that in the attempt to solve the birdnesting problem, the conventional chaff system designer has tended to implement conplex dispensing systems with a consequent decrease in the reliability of operation of conventional chaff systems. In the system of the present invention, the wires are loaded and dispensed from their straight positions in dispensers with no added complexity for the reliable operation of wires.

The vulnerability of a chaff wire in free space is a function of the wire diameter, the wire material, the angle of incidence, and the spectrum of the nuclear radiation. If the angle of incidence and the spectrum of the nuclear radiation remian fixed, increasing the wire diameter will decrease the wire vulnerability. The system of the present invention when compared to a conventional chaff system always employs wires at the larger wire diameters and as a consequence, it is expected that the system of the present invention will be less vulnerable to nuclear radiations.

The re-entry slowdown characteristic of a wire is determined by the wire's ballistic coefficient which is a well known function of the wire diameter. Larger size wires are heavier and consequently have higher ballistic coefficients. The system of the present invention when compared to a conventional chaff system always employs wires at the larger wire diameters and as a consequence, it is expected that the system of the present invention will penetrate deeper into the lower atmosphere in ballistic type applications.

Using the off-resonant chaff system of the present invention, therefore, allows for a significant improvement in the effectiveness (masking performance, cost, reliability, vulnerability, and penetrability) of chaff systems used in the concealment of large radar targets viewed by low frequency radar. This imporvement can be accomplished by using unfolded, uncoiled wires in their straight configuration when deploying the dispensing the chaff. This procedure and design is exactly opposite the procedure and design of conventional chaff systems for masking large radar targets at very low radar frequencies.

It should be understood that the descriptions in the drawings and disclosure represent averaged out results and provided to illustrate the performance of a typical wire and that wires composed of different materials will deviate somewhat in their performances. Also, it should be understood that the choice of a length-to-diameter ratio and diameter for a dipole is a design choice wholly determined by the application. For example, in FIG. 1 the choice of a length-to-diameter ratio 3000 confines the birdnesting loss within −3db (only 50 percent of dipoles remain effective) and that the choice of 5000 for this ratio confines the birdnesting loss to within −10 db (only 10 percent of dipoles remain effective) and that the actual choice for this ratio is determined by the design tolerance and wire material. The situation is similar for the choice of the dipole diameter in FIG. 2.

Although a particular simplified off-resonant chaff system has been described by example, it should be understood that the scope of the invention should not be considered to be limited by the particular embodiment of the invention shown by way of illustration, but rather by the appendant claims.

I claim:

1. A method for masking large targets viewed by radar operating at VHF or lower frequency comprising
   dropping a plurality of separable electric conductors of a length forming dipoles resonating at a frequency substantially above the frequency of the radar, and
   having a length-to-diameter ratio not substantially more than 3000 providing substantially rigid conductors, and
   having a diameter not substantially less than one thousandth of an inch providing low ohmic losses.

2. A method as defined in claim 1 wherein said conductors have a uniform length.

3. A method as defined in claim 1 wherein said conductors are about 20 inches long and about six thousandths of an inch diameter.

4. A method as defined in claim 1 wherein the resonating frequency of said dipoles is in the UHF band.

* * * * *